United States Patent [19]

Harvey et al.

[11] Patent Number: 4,701,184

[45] Date of Patent: Oct. 20, 1987

[54] UPGRADING SOLID FUELS

[75] Inventors: Kaye F. Harvey, North Carlton; Reginald B. Johns, North Balwyn; Alan S. Buchanan, Kallista; David A. Cain, Heidelberg, all of Australia

[73] Assignees: The University of Melbourne; CRA Services Limited, both of Australia

[21] Appl. No.: 827,319

[22] Filed: Feb. 7, 1986

[30] Foreign Application Priority Data

Feb. 14, 1985 [AU] Australia ..... PG9283

[51] Int. Cl.[4] ..... C10L 5/06; B02C 23/18

[52] U.S. Cl. ..... 44/10 D; 44/1 G; 44/10 F; 241/15

[58] Field of Search ..... 44/10 F, 10 D, 1 G

[56] References Cited

U.S. PATENT DOCUMENTS 3,758,385 9/1973 Fischer ..... 44/10 D 4,627,575 12/1986 Johns et al. ..... 241/15

FOREIGN PATENT DOCUMENTS 16126 10/1929 Australia ..... 44/10 D 200524 10/1924 United Kingdom ..... 44/10 F

*Primary Examiner*—Carl F. Dees

*Attorney, Agent, or Firm*—Larson and Taylor

[57] ABSTRACT

Process for treatment of brown coal which comprises subjecting the said coal to shearing forces to produce a plastic mass which is capable of conversion by subsequent compaction and drying into a fuel of increased density and enhanced calorific value, is characterized in that the water content of the coal is more than 54% and the shearing forces are applied for less than one hour, shorter times being preferred, for example less than 30 seconds. A preferred embodiment provides a continuous process in which the coal is treated in a machine that subjects it to sequential steps of shearing and extrusion in a continuous manner. The extruded product after drying provides the fuel of increased density and enhanced calorific value. The desired effect may also be obtained by treating part of a quantity of brown coal and blending the treated portion with the untreated remainder of the said quantity.

16 Claims, 2 Drawing Figures

UPGRADING SOLID FUELS

Figure 1:
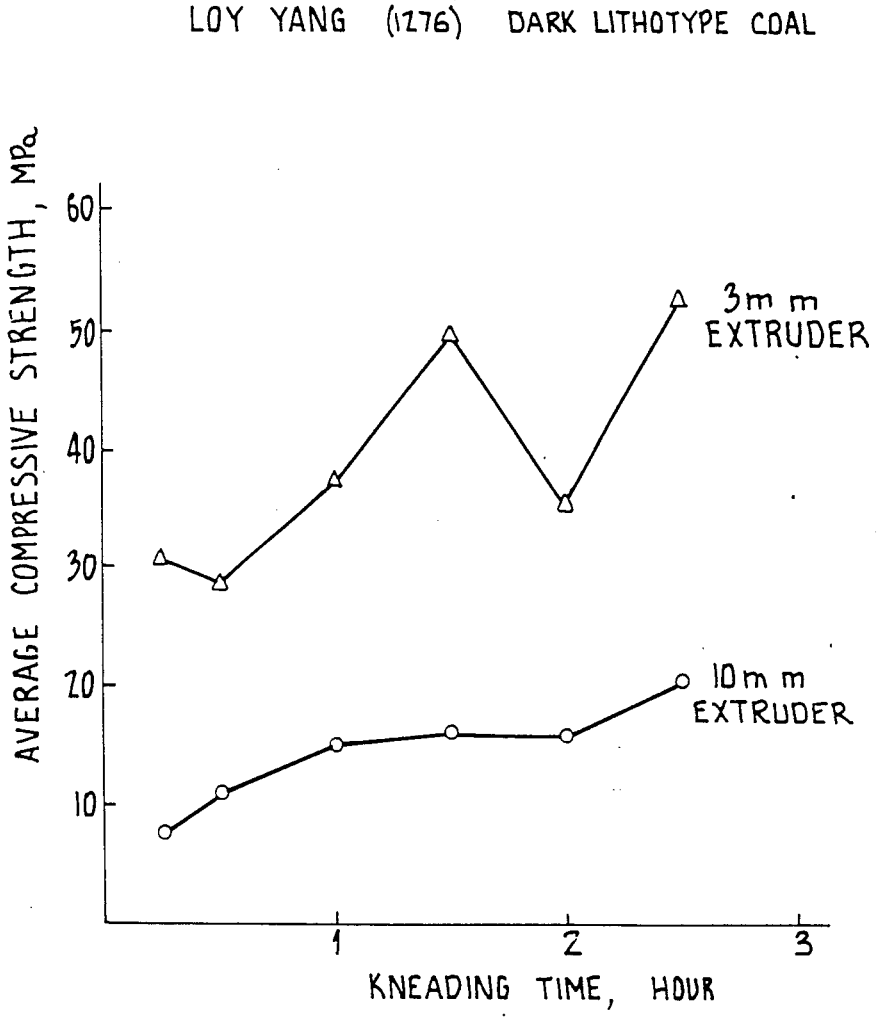

This invention relates to an improvement in the process for upgrading brown coal which is the subject of our U.S. Pat. No. 4,627,575.

Brown coals as mined usually have a total moisture content greater than 60%, and in the raw state are soft, friable, low-density materials constituting a very low grade fuel.

Existing processes for upgrading brown coal include briquetting and solar drying.

Briquetting represents a widely used and long established technology to convert brown coal into a hard fuel of higher calorific value. Procedures generally involve drying the raw coal (with an 'as mined' water content generally in excess of 55%) by the application of thermal energy. A water content of 18% is usually sought as an optimum for subsequent briquetting. The dried coal is pressed after cooling to a temperature of 40°-50° C. in an extrusion press or roll briquetting machine.

In this process much thermal energy is required to dry the coal and considerable mechanical work with associated wear is involved in the briquetting operation. As a consequence the briquettes, although they are a high quality fuel, are correspondingly expensive to manufacture.

In recent times solar drying of brown coal to produce a hard product having a water content of the order of 5-10% has been proposed. In this process raw brown coal with 20-25% added water is milled in a ball mill for periods of up to 16 hours. The thixotropic slurry so produced is then exposed in shallow ponds to lose water with solar assistance. During the drying the slurry becomes hard, dark in appearance and resistant to water (that is, the solid is not substantially degraded when contacted with liquid water). The time of drying varies with the weather but may well occupy several months. This process yields a reasonably satisfactory product which may be somewhat variable in quality. It is prolonged both in respect of milling time and exposure of the slurry in solar ponds. The lengthy milling is, of course, energy intensive.

The invention described in our U.S. Pat. No. 4,627,575, which provides a process for the conversion of brown coals to a hard, relatively dense solid form of fuel of much smaller residual water content and substantially enhanced calorific value per unit weight, has important advantages over existing briquetting and solar drying processes for upgrading brown coal.

As stated, raw coal frequently has a water content in excess of 60% and its calorific value is accordingly low. By contrast with conventional briquetting no introduced thermal energy is required for removal of this water in that process. By contrast with the solar drying process no additional water is required for the attritioning of 'as mined' coal, the time required for attritioning is considerably reduced and the final drying step takes place over 3-5 days instead of several months (depending on weather conditions). The alternative processes are thus seen to be relatively inefficient and may even be uneconomic.

The invention of our said U.S. Pat. No. 4,627,575 is characterized by subjecting the coal in a first attritioning step to shearing, as distinct from grinding, forces. This treatment densifies the coal into a mass which is capable of compaction, for example by extrusion, into a coherent solid form which is very convenient for efficient drying and handling. Extruded pellets made in this manner may be dried merely by exposure to the atmosphere, preferably at or near ambient temperature.

Although the disclosure in our said copending application was not limited to a minimum attritioning time for brown coal comminuted in the kneading/shearing type of device mentioned therein, it was believed at that time that the necessary duration of this step would be of the order of hours rather than minutes and accordingly it was suggested therein that attritioning times upwards of 1 to 1½ hours may be appropriate, and in a specific example the coal was subjected to attritioning in a kneader for 5 hours.

We have now surprisingly found that shorter treatment times for this step are also effective, and may even be more effective than the longer times contemplated in our previous work.

The least time required for shearing-attritioning of raw brown coal in the densification process is that which is sufficient to generate perceptible moistness and plastic character in the mass of the coal. In practice the required condition is verified by visual observation based upon experience. The period of time is a function of the rate of operation of the attritioning machine, the intensity of the shearing action achieved by the machine and of the efficiency of the machine in forcing the coal constantly into the shearing zone.

In respect of the latter the water content of the coal can be critical; if too low, machine efficiency decreases severely. Experience indicates that brown coals with water contents of about 60% by weight display optimum shearing-attritioning characteristics whereas water contents in the vicinity of 54% (or less) are unsatisfactory.

Using a sigma kneading machine operating with kneading shaft speeds of 40 and 20 r.p.m. and a rotor-wall clearance of 0.3 mm, various brown coals of Victorian and German origin have been successfully converted to extrudable plastic states in periods of 30 seconds shearing attritioning. However 30 seconds should not be regarded as the minimum time covered by the present claim since the time will be governed to a significant degree by the effectiveness of the available machine. Any period sufficient to convert the raw brown coal to an extrudable plastic state will be appropriate.

It should be noted that in practice short shearing-attritioning times giving limited size reduction of the coal particles may be compensated to some extent by the subsequent use of high extrusion pressures. In fact a relatively dry plastic mass leads to the development of high pressures in the nozzle region of the extruder.

A further preferred embodiment of the present invention provides a continuous shearing-extrusion process. The very short attritioning times now described permit continuous operation in which brown coal in small lumps (5 mm or less) is fed continuously to a low-speed (20-40 revolutions per minute) sigma-type shearing-attritioning machine. The configuration of this machine is designed to give a residence time for the coal in the shearing zone of the required order (as defined above) before being extracted by a suitably located discharge screw. The discharge screw feeds the moist attritioned coal to an extrusion head designed to give the required extrusion pressure and provide pellets sufficiently firm to withstand reasonable loads immediately after formation.

The present invention accordingly provides an improvement in the invention disclosed in our U.S. Pat. No. 4,627,575, characterized in that the coal is subjected to shearing forces for less than one hour, the beneficial effects being observed with treatment times as short as one minute or even less.

The machine which performs the functions described above and has a discharge screw and extruder fitted integrally is Sigma Knetmachine HKS 50 manufactured by Janke & Kunkel GmbH & Co. KH IKA-Werk Beingen.

Although we do not wish to be limited by any postulated or hypothetical mechanism for the observed beneficial effects, it now appears to us that densification will begin to proceed at an appreciable rate as soon as sufficient cleaved/sheared coal surfaces are available. this leads to a further improvement providing a continuous process in which the coal has a residence time in the attritioning (shearing) zone just sufficient to produce material capable of being effectively extruded in a high pressure extrusion or pressing device.

The improvement subject of the present invention will be further illustrated by the following non-limiting examples:

EXAMPLE 1

Darl lithotype coal from the Loy Yang deposit in the Latrobe Valley (Loy Yang 1276) was subjected to attritioning for a range of different times, and the average compressive strength of extruded pellets obtained from the resultant mass was measured. The results are shown in FIG. 1. The results indicate that:

- good strength pellets can be made using attritioning times of 5 minutes or even less,
- extrusion pressure is very effective in enhancing pellet strength (a 3 mm diameter extruder gives pellets about 3 times as strong as those provided by a 10 mm diameter extruder),
- even in the absence of additives there is some evidence for the existence of maxima and minima in the curves of pellet strength vs. attritioning time.

Visual observation during the course of these experiments indicated that while coal kneaded for 5–10 minutes did not have a wet plastic consistency, it nevertheless had become damp and had some plastic character—certainly sufficient for effective extrusion. Even shorter attritioning times should be feasible. The high extrusion pressure generated with the 3 mm diameter extruder are sufficient on occasion to cause a separate water phase to appear. The extruded pellets are quite coherent and do not stick together indicating that they could be piled in a substantial column without adverse effects.

In the light of the data and the observations described above we conclude that good quality densified pellets could be prepared from bed-moist coal using attritioning times of a few minutes only, provided that an efficient machine was used which kept the coal constantly in the shearing zone and in which the separation of the fixed moving surfaces was small enough (of the order of 0.3 mm) to give high shear and that relatively high extrusion pressures are used so as to force the coal fragments into close proximity.

Experience with the kneader, which has been in use constantly for about 1½–2 years, indicates that wear would be very small in the attritioning machine. Evidently the moistness of the coal is effective in providing lubrication and the low machine speed may help also. The same comment applied to the liquid water phase which usually develops, considerably assisting the extrusion process.

EXAMPLE 2

A further series of tests using Narracan (N3372) coal was conducted with the water content standardised at 60%. No additive was used. The average compressive strengths at various kneading times are shown in the attached FIG. 2. The results in general accord well with those obtained with Loy Yang dark lithotype coal. Attritioning times as low as five and ten minutes were added to the range previously investigated. The kneading machine was used with the sigma-shaped head which gives maximum shearing efficiency, since it ensures that the coal spends the whole of the machine time in a shearing zone. Extrusion was performed with a hand-operated screw extruder fitted alternately with 10 mm and 3 mm diameter nozzles.

Figure 2:
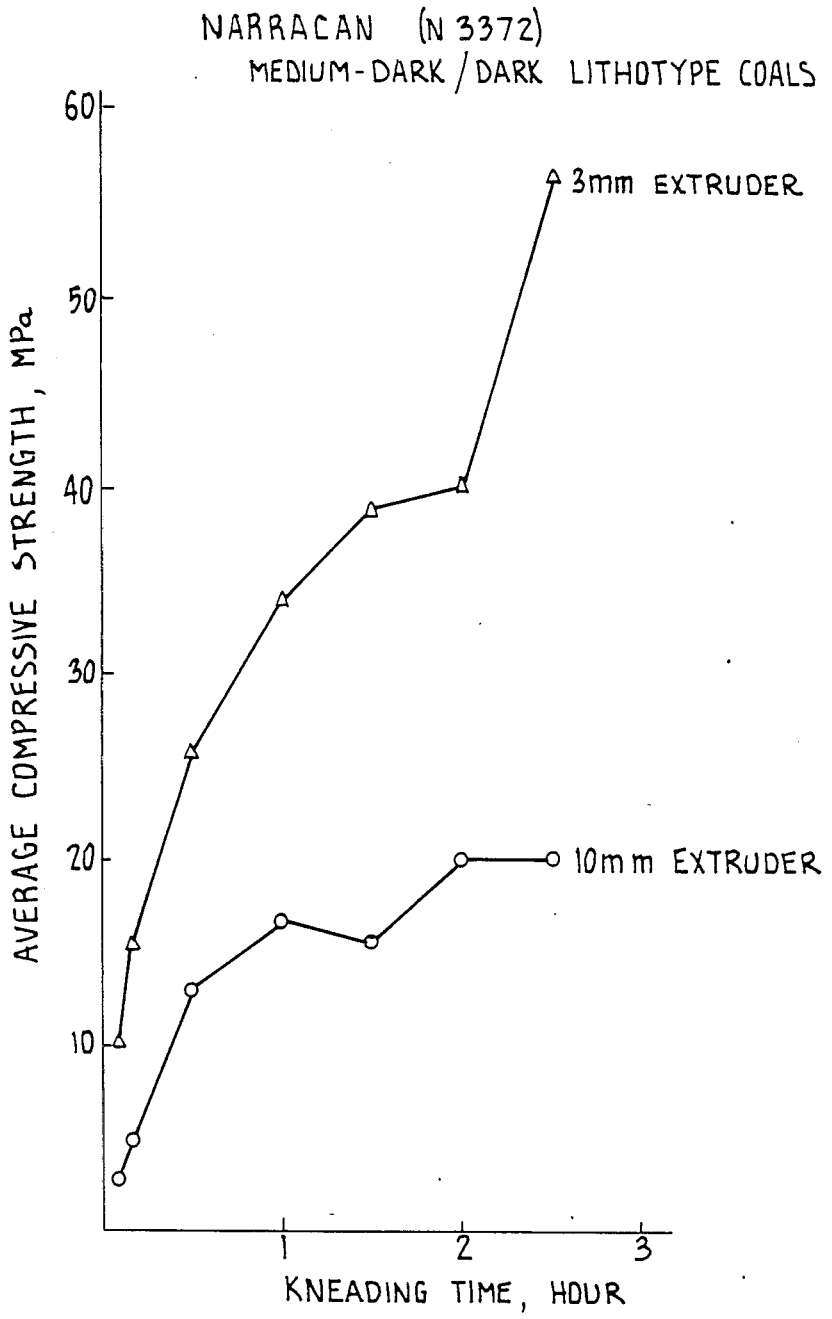

FIG. 2 shows that pellets of sufficient strength to be usable were produced from the five and ten minute-attritioning experiments. This is especially true for the high extrusion pressures generated with the 3 mm diameter nozzle. In these short-time experiments, while the coal did not have enough time to become appreciably damp in appearance, it still extruded satisfactorily, giving coherent pellets able to sustan appreciable loads without deformation.

If higher strengths are required in pellets produced by short attritioning times, these could be achieved by the use of:

(a) a faster attritioning machine to produce smaller particles for a given residence time and hence improved densification.

(b) higher extrusion pressures to compensate to some degree for less efficient attritioning, and which could be expected to assist the extrusion process, or (c) an additive such as ammonium hydroxide (0.1–0.5%).

Further discussion of the more general aspects of the invention will be found in the specification of our U.S. Pat. No. 4,627,575 and the entire disclosure of that specification is by this cross-reference incorporated into the present specification.

It will be clearly understood that the invention in its general aspects is not limited to the specific details referred to hereinabove. The claims defining the invention are as follows.

We claim:

1. Process for treatment of brown coal which comprises subjecting the said coal to shearing forces to produce a plastic mass which is capable of conversion by subsequent compaction and drying into a fuel of increase density and enhanced calorific value, characterised in that the water content of the coal is more than 54% and the shearing forces are applied for less than one hour.

2. Process according to claim 1 in which the shearing forces are applied for less than one minute.

3. Process according to claim 1 in which the shearing forces are applied for less than 30 seconds.

4. Process for treatment of a quantity of brown coal to produce a plastic mass which is capable of conversion by subsequent compaction and drying into a fuel of increased density and enhanced calorific value, which comprises subjecting a portion of the said quantity to shearing forces for a period of less than one hour and blending the so-treated portion with the remainder of the said quantity to produce the said plastic mass.

5. Process according to claim 4 in which the shearing forces are applied for less than one minute.

6. Process according to claim 4 in which the shearing forces are applied for less than 30 seconds.

7. Process for upgrading brown coal which comprises subjecting the brown coal to shearing forces in a first step to produce a plastic mass, compacting the said plastic mass in a second step to produce a compacted mass, and drying said compacted mass in a third step to produce a dry product of increased density and enhanced calorific value, characterised in that the water content of the coal is more than 54% and the shearing forces are applied for less than one hour.

8. Process according to claim 7 in which the shearing forces are applied for less than one minute.

9. Process according to claim 7 in which the shearing forces are applied for less than 30 seconds.

10. Process according to any claim 7, in which the compacting step is effected by extruding the plastic mass.

11. Process according to claim 7 in which the drying step is effected at or near ambient temperature.

12. A continuous process for production of an upgraded brown coal product which is capable of being dried at ambient temperature to produce a fuel of increased density and enhanced calorific value, characterised in that raw brown coal containing more than 54% water is treated in a machine that subjects it to sequential steps of shearing and extrusion in a continuous manner to produce the said product.

13. Process for upgrading brown coal which comprises treating raw brown coal by the continuous process defined in claim 12 and drying the product of that process to produce a fuel of increased density and enhanced calorific value.

14. The product of a process according to claim 1 .

15. The product of a process according to claim 7.

16. The product of a process according to claim 10.

* * * * *